United States Patent [19]

Baxter et al.

[11] Patent Number: 4,882,997

[45] Date of Patent: Nov. 28, 1989

[54] TUBULAR PROJECTILES

[75] Inventors: James E. Baxter, Cheshire; Robert D. Poole, Stoke-on Trent, both of England

[73] Assignee: Royal Ordnance plc, London, England

[21] Appl. No.: 126,010

[22] Filed: Nov. 27, 1987

[30] Foreign Application Priority Data

Nov. 28, 1986 [GB] United Kingdom ..... 8628514

[51] Int. Cl.[4] ..... F42B 11/00; F42B 11/16

[52] U.S. Cl. ..... 102/503; 102/513; 102/523

[58] Field of Search ..... 102/503, 513, 520, 522, 102/523, 529

[56] References Cited

U.S. PATENT DOCUMENTS

| | | | |
|---|---|---|---|
| 3,972,291 | 8/1976 | Braun, Jr. et al. | 102/513 |
| 4,043,269 | 8/1977 | Ambrosini | 102/513 |
| 4,097,711 | 6/1978 | Ramnarace | 102/513 |
| 4,301,736 | 11/1981 | Flatau et al. | 102/503 |
| 4,381,712 | 5/1983 | Black | 102/503 |
| 4,519,316 | 5/1985 | Bethmann et al. | 102/513 |
| 4,671,179 | 6/1987 | Synofzik et al. | 102/513 |
| 4,735,147 | 4/1988 | Halverson | 102/522 |

*Primary Examiner*—Harold J. Tudor

*Attorney, Agent, or Firm*—Stevens, Davis, Miller & Mosher

[57] ABSTRACT

A tubular projectile suitable for use in training ammunition comprises a hollow tube having formed in the rear end of the tubular wall thereof a recess in which is embedded a tracer material.

The projectile may be sabot launched.

Constructions are described for igniting the tracer material directly or indirectly from the gases produced by burning of the main propellant charge when the projectile is fired from a gun, e.g. the RARDEN Gun of the Applicants.

Example of suitable tracter materials and techniques for filling the said recess with them are also described.

16 Claims, 4 Drawing Sheets

TUBULAR PROJECTILES

The present invention relates to tubular projectiles.

UK Patent No. 1,571,010 assigned to the present applicant Company describes a supersonic tubular projectile invented by Abraham Flatau and Joseph Huerta, which may be used in (but not exclusively in) training ammunition rounds. For example, the projectile may be incorporated as a sub-calibre component in discarding sabot training rounds fired from the 30mm RARDEN (Registered Trade Mark) gun of the present applicant Company.

The present invention provides a novel tubular projectile which may optionally comprise a beneficially modified form of the projectile described in UK Patent No. 1,571,010.

According to the present invention there is provided a tubular projectile comprising a hollow tube having formed in the rear end of the tubular wall thereof a recess in which is embedded a tracer material.

By a "tracer material" is meant any material which may be incorporated in a projectile for the purpose of tracing or tracking the trajectory of the projectile.

Preferably, the recess extends forward from the rear surface of the rear end of the tubular body of the projectile. The rear surface desirably comprises a flat annulus or a frustro-conical surface. Where the rear surface is frustro-conical it may extend and taper inwardly from the trailing edge of the projectile, ie. forming a mouth at the rear end of the hollow portion of the projectile tube. Alternatively, the frustro-conical surface may be on the outer surface of the projectile tube tapering toward the axis of the projectile at a point behind the projectile.

Preferably, the inner and outer lateral extremities of the recess, as observed at the rear end of the projectile, are contained in an intermediate region between the inner and outer diameters of the rear surface annulus, although the tracer-embedded recess could comprise substantially the entire rear surface of the projectile.

The recess may comprise a recess of annular cross-section, the recess annulus preferably being substantially coaxial with the portion of the projectile in which it is formed.

Alternatively, the recess may comprise one or a plurality of discrete holes extending into the rear projectile wall in its rear portion in a direction parallel to the projectile axis. The hole or holes may comprise one or more holes of circular or other suitable cross-section, e.g. an arcuate shape such as a bent rectangular or bent oval (e.g. sausage) shape. The holes preferably are arranged in cross-section in a circular formation.

The recess may be formed by machining, e.g. drilling into the rear end of the projectile rear wall. As a preferable alternative the recess is formed by fitting a suitable insert section into the inner or outer wall of the projectile in its rear portion whereby the recess is formed as a gap between the insert and the rear portion of the inner or outer wall of the projectile body at its rear end. For example, a tubular insert may be fitted in the rear inner wall of the projectile. The tubular insert may have one or more grooves or an annular recess in its outer surface. Alternatively, or in addition, the rear inner wall of the projectile may be stepped or grooved in the region where the insert is fitted to provide the required recess. The tubular insert preferably has an inner surface (ie. facing inward toward the axis of the tube) which forms a surface substantially continuous with the main inner surface of the body of the projectile. For example, the projectile body inner surface may contain a step against which the insert abuts, e.g. as an interference fit or by a bonding agent.

Where the said insert contains one or more grooves or an annular recess for receipt of tracer material the tracer material may be applied to the insert before insertion of the insert into the projectile.

Alternatively, the said insert may be fitted as a collar at the rear end of the projectile in a suitable recess containing a region of increased depth toward the rear end of the projectile, the tracer material being located in the region of the recess having increased depth inside the insert. Preferably, the insert outer surface and the outer surface of the projectile body forward of the insert provide a substantially continuous surface.

The present invention provides a highly convenient and advantageous technique for incorporating a tracer material, e.g. a tracer composition, in a round incorporating a tubular projectile without substantially affecting the aerodynamic properties of the projectile.

The tracer material embedded in the said recess in the projectile according to the present invention may be any known tracer material. It may conveniently be provided as one or more pliant lengths of tracer material contained in an inert flexible sleeve, e.g. made of malleable metal such as lead, lead-antimony alloy, copper, aluminium, or of a plastics material fitted in the recess.

The tracer material provided in this form may be sealed in the recess by any known bonding agent, e.g. a suitable epoxy resin inside and/or at the exit to the recess. Alternatively, a tracer composition may be extruded, pressed or cast directly into the recess.

The tracer material incorporated in the projectile according to the present invention permits the trajectory of the projectile to be tracked. The tracer composition may be a composition which strongly emits visible light when ignited. It could, however, be a composition which is a strong smoke emitter or an infra-red radiation emitter (which may, for example, be tracked by an infra-red detector) or a material which strongly reflects radio or microwave frequencies, e.g. for tracking by radar.

For example, where the tracer material comprises an emitter of visible light it may comprise a pyrotechnic or chemiluminescent material. Many such materials which could be used as pyrotechnic materials are well known to those skilled in the projectiles field. For example, such compositions may comprise a metallic fuel such as powdered magnesium, aluminium titanium or zirconium and an energetic oxidiser such as an inorganic nitrate or perchlorate, e.g. of ammonium, barium or strontium optionally together with a polymeric binder, e./g. a polyester or polyurethane.

Suitable specific examples of pyrotechnic tracer compositions include the compositions commercially supplied by the present applicants under the designations SR889 and SR390B.

Where the projectile according to the present invention incorporates a tracer material in a recess of annular cross-section we have found that an advantageous technique for filling the recess with tracer material comprises employing a flexible cylindrical sleeve of a polymer bonded pyrotechnic composition to fill the recess.

A suitable composition for use in the aforementioned flexible sleeve comprises a metallic fuel and one or more fluoroelastomers serving as an oxidiser and flexible binder. A suitable composition comprises magnesium 30 to 60 per cent by weight, polytetrafluorethylene 35 to 50% by weight and a rubbery binder 5 to 25% by weight. A suitable rubbery binder is a known copolymer of vinylidene fluoride and hexafluoropropylene.

A preferred composition for use in the aforementioned flexible sleeve comprises magnesium 48% by weight; polytetrafluorethylene 35% by weight and a copolymer of vinylidene fluoride and hexafluoropropylene 17% by weight.

The aforementioned flexible sleeve may be produced by mixing the ingredients together as powders or particulate solids in the presence of a solvent such as acetone or ethyl acetate to form a soft processible dough-like mass. This is then cast, pressed or extruded into sheets. The solvent is allowed to evaporate from the sheets by drying in a warm atmosphere. After drying the resulting sheets which are pliant are cut to size and then rolled around a cylindrical former to produce the required sleeve as a pre-form for insertion into a projectile.

Alternatively, the sleeve may be formed by direct extrusion of a tubular shape from an extruder. It may for instance be convenient to extrude elongate tubes and then to cut these to size to form sleeves prior to drying.

A sleeve formed in one of the ways described above may be incorporated in the recess in a tubular projectile by insertion using a suitable guidance tool followed by consolidation using a plate driven by a hydraulic press Alternatively, a sleeve produced by extrusion may be extruded directly into the recess.

A further alternative process for filling a projectile recess with a sleeve of tracer material is to provide the projectile in a form in which the outer collar shaped ring of the projectile surrounding the recess is flared whereby the recess has a greater cross-sectional area at its outer end. The recess may then be filled with tracer material, in one of the ways described above, and, after evaporating of the solvent, this may be consolidated by swaging down the flared outer surface of the projectile, eg. by pushing the projectile through a die or using rollers or any other well known swaging technique, whereby the required final shape of the projectile outer profile is obtained with the tracer material embedded in the recess therein.

Where a tubular projectile is used in conjunction with a sabot, according to the present invention the tubular projectile preferably has in cross-section in a plane containing the projectile axis a front portion having an inner surface conically converging in a direction facing toward the rear end of the projectile, an intermediate portion having an inner surface of substantially constant diameter and a rear portion having an inner surface conically diverging in a direction facing toward the rear end of the projectile. The material of which the body of the tubular projectile according to the present invention is made is not critical although high strength metallic materials are preferred. The material may for example be aluminium alloy, steel or in armour piercing applications, denser metal such as tungsten alloy. Generally, the overall shape of the projectile according to the present invention is desirably the same as that which is described and claimed in UK Patent No. 1,571,010 except that the sharp boattail rear end of that projectile is preferably replaced by a flat or frustro-conical annular surface as specified hereinbefore.

The tubular projectile according to the present invention may be a sub-component of a discarding sabot round, e.g. as described in UK Patent No. 1,571,010. The sabot may be made of a plastics material or a light metal, e.g. aluminium alloy. A driving band imparting spin from the rifling groove of a gun barrel to stabilise the projectile in flight may be provided, for example, on the sabot outer surface.

Alternatively the projectile according to the present invention may be a full calibre projectile and may for example be provided with a driving band on its outer surface.

A base member, e.g. a pusher or pusher/obturator may be provided to impart the main launch forces upon the rear end of the projectile and its sabot if included. The base member may for example be made of a high strength plastics material such as polycarbonate material.

Where the tracer material incorporated in the projectile according to the present invention comprises a composition which is ignited to emit visible light during flight of the projectile the tracer composition may be ignited in a direct or an indirect manner when the propellant charge provided to launch the projectile is initiated. Preferably, a base member, e.g. used as a pusher in conjunction with the projectile has a groove, e.g. an annular groove, facing the recess in the projectile incorporating the tracer composition to facilitate such ignition Preferably the groove is sealed by the rear surface of the rear end of the projectile in which the said recess is incorporated. Such a groove permits ignition of the tracer composition without venting of the propellant gas by the main hollow aperture of the projectile.

In a construction for the indirect ignition of the tracer composition an igniter device located behind the projectile, e.g. housed in the base member substantially on the axis of the projectile, may be of a known kind which is arranged to be initiated by the set-back force or spin of the projectile, e.g. by the action of pressure or a striker on a suitable composition, for example, an impact sensitive composition comprising lead azide. This device may be conveniently arranged to deliver when ignited hot gas to the tracer composition. For example, the igniter device may be located in a cavity in a base member which has one or more bleed channels extending from the cavity to a surface of the base member, e.g. at the said groove in a region adjacent to the recess of the projectile in which the tracer composition is incorporated. Where the pusher in this form of the invention has an annular groove facing the recess incorporating the tracer composition the hot gas emerges at this recess to ignite the tracer composition.

In a direct construction for ignition of the tracer composition hot gas obtained from the ignition of the main propellant charge may be bled through a narrow bleed hole or channel in the base member to the groove in the base member facing the recess in which the tracer composition is incorporated.

In this way the tracer composition may be ignited whilst restricting the build-up of gas pressure behind the projectile. A septum or burster disc or annulus may be provided in the path of the gas to delay the flow of hot gas to the tracer composition, thereby delaying the undesirable build-up of gas pressure upon the rear of the projectile.

Embodiments of the present invention will now be described by way of example with reference to the present invention in which.

Figure 1:
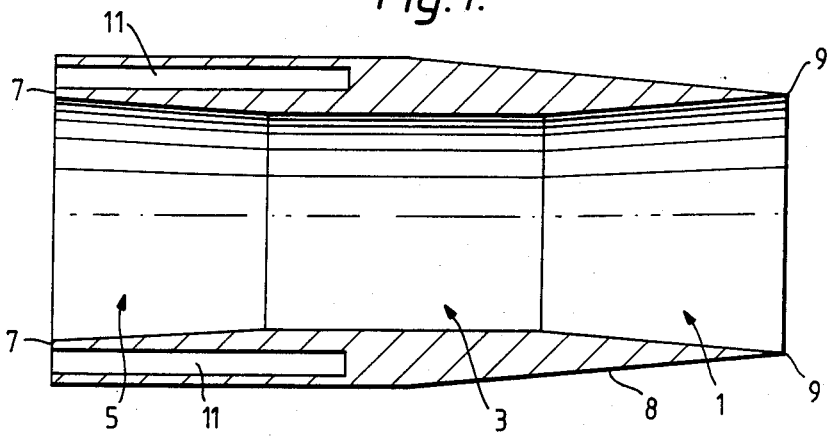
FIG. 1 is a cross-sectional side view of a tubular projectile embodying the present invention.

In FIG. 1 a tubular projectile comprises a front portion 1, a middle or body portion 3 and a rear portion 5. In the front portion 1 the internal diameter converges conically in a direction facing toward the rear portion 5. In the middle portion 3 the internal diameter is constant. In the rear portion the internal diameter diverges conically in a direction facing away from the front portion 1. The rear portion 5 has a flat annular rear surface 7. The outer surface of the front portion 1 has a converging section 8 which meets the inner surface at a sharp annular leading edge 9. The outer surface is of constant diameter in the middle portion 3 and rear portion 5 behind the converging section 8. A recess 11 of annular cross-section is formed in the rear portion 5. This extends from the rear surface 7 inward to occupy part of the middle portion 3 in a direction parallel to the axis of the projectile. The recess 11, which may be formed by machining, is filled with a tracer composition in one of the ways described above.

Figure 2:
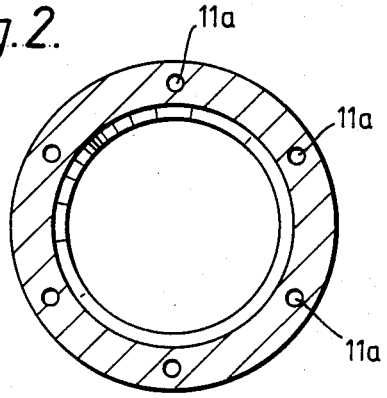
FIG. 2 is a cross-sectional end view of an alternative tubular projectile embodying the present invention.

In the alternative embodiment shown in FIG. 2 the recess 11 is replaced by individual holes 11*a* which may be formed e.g. by machining and filled with tracer material in one of the ways described above.

In the alternative embodiment shown in FIG. 2, the recess 11 is replaced by individual holes 11*a* which may be formed e.g. by drilling and filled with tracer material in one of the ways described above.

Figure 3:
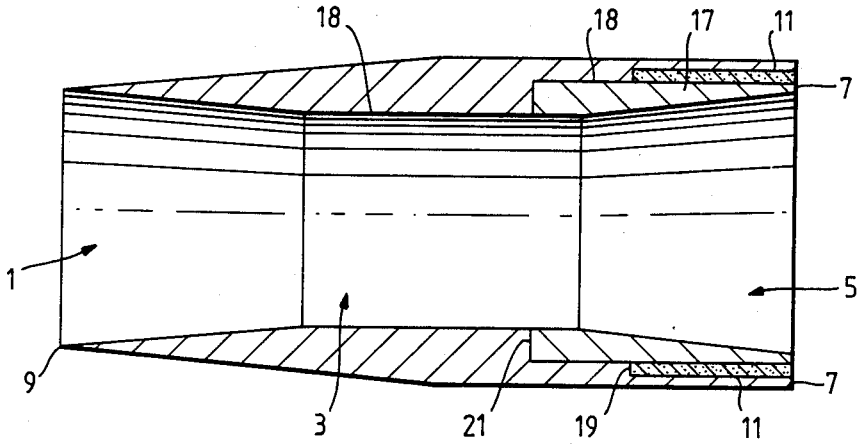
FIGS. 3, 4 and 5 are cross-sectional side views of alternative tubular projectiles embodying the present invention.

In FIG. 3 parts similar to those shown in FIGS. 1 and 2 are given the same reference numerals. In the case of the FIG. 3 embodiment, the annular recess 11 again extends from the rear surface 7 through the rear portion 3 in a direction parallel to the projectile axis. However, in this case the recess 11 is formed between an insert 17 and the inner wall of the body, indicated by reference numeral 18, forming the remainder of the tubular projectile. The insert could have axial grooves to provide the required recess rather than by forming this as a gap between the insert and the body of an inner wall of the body. The inner wall of the body 18 has been machined to form a step 19 to provide the recess 15 with the insert 17 included. The insert 17 abuts against a further step 21 machined in the inner wall of the body 18 and has an inner surface which is substantially continuous with that of the inner wall of the body 18 forward of the insert 17. The recess 15 is filled with a tracer composition in one of the ways described above.

Figure 4:
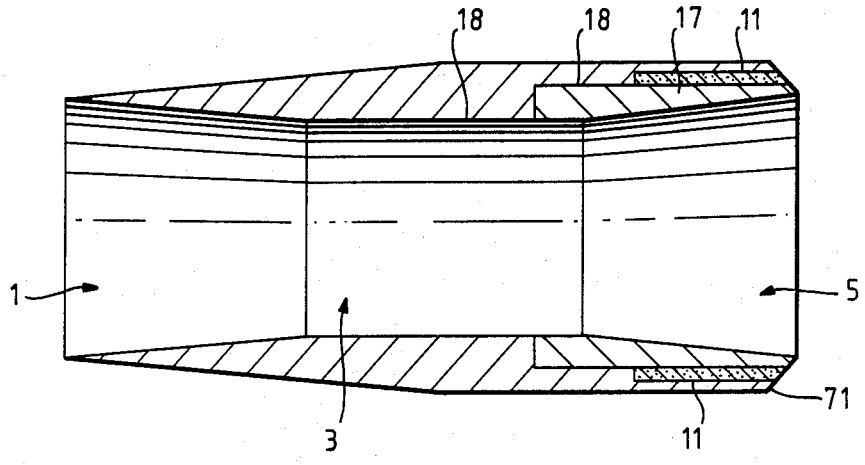

In FIG. 4, parts similar to those shown in FIG. 3 are given the same reference numerals. In the case of the FIG. 4 embodiment the flat annular rear surface 7 shown in FIG. 3 is replaced by a frustro-conical annular rear surface 71. This has the added advantages of an increased rear surface area of the tracer-filled recess 11, to increase the burning area of the tracer material therein, and also a reduced drag on the rear of the projectile. The recess 11 extends inwardly parallel to the axis of the projectile from the surface 71.

Figure 5:
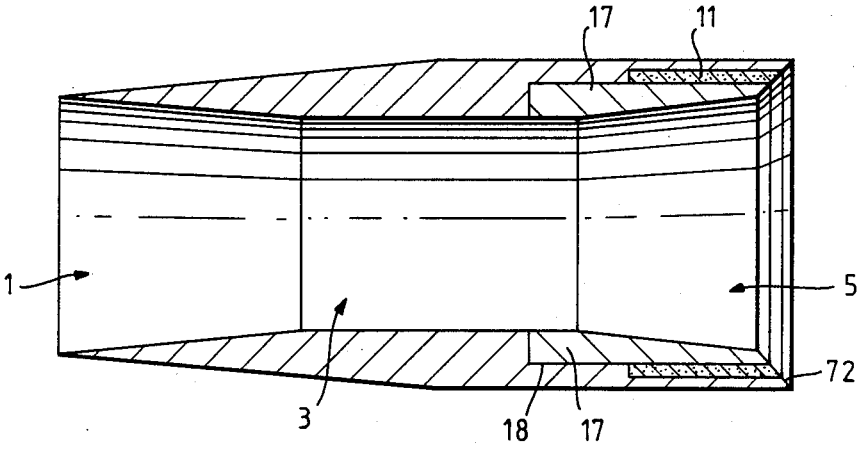

In FIG. 5 parts similar to those shown in FIG. 3 are given the same reference numerals. In the case of the FIG. 5 embodiment the rear surface 71 in FIG. 4 is replaced by an inwardly sloping frustro-conical rear surface 72 from which the annular recess 11 extends inwardly.

In an alternative embodiment of the present invention (not shown) an insert replacing the insert 17 may have axial grooves to provide discrete holes (rather than an annulus) in which tracer material is embedded.

Figure 6:
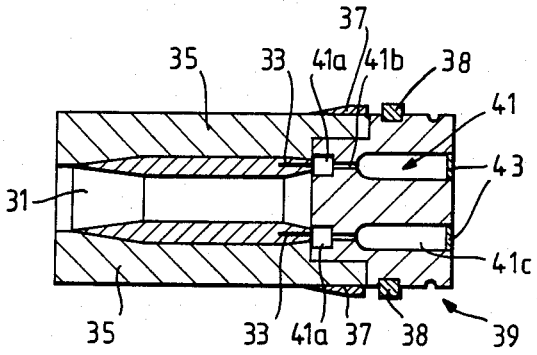
FIG. 6 is a part cross-sectional side view of a construction embodying the present invention comprising a tubular projectile together with its associated driving components.

FIG. 6 illustrates a construction for launching a tubular projectile embodying the present invention and for igniting the tracer composition therein by a direct 31 may be of the form shown in FIG. 1 or of the form shown in FIG. 3. The tracer composition of the projectile 31 is indicated by reference numeral 33. A sabot 35 (which may for example be formed of segments in a known manner) is fitted around the projectile 31. A driving band 37 is attached to the outer surface of the sabot 35. A base pusher 39 carrying an obturator 38 is located behind the rear surface of the projectile 31 and the sabot 35. The pusher 39 has an annular channel 41 extending therethrough in a direction parallel to the axes of the pusher 39 and projectile 31. The channel 41 has three regions, namely an annular recess 41*a* facing the tracer composition 33, a narrow portion 41*b* and a wider portion 41*c* behind the narrow portion 41*b*. The wider portion 41*c* houses an annular septum 43.

In operation, the base pusher 39 is contained inside a gun in a conventional launch cartridge (not shown) in front of a known gun propellant (not shown). When the gun is fired the propellant is ignited causing a rapid expansion of gas which is obturated by the obturator 38. The pressure built up causes the projectile 31 and sabot 35 to be driven by the pusher 39 in a forward direction out of the gun. The driving band 37 engages the rifling of the gun (not shown) to impart spin to the projectile to maintain stability of the projectile in flight.

When the pressure of the hot propellant gas produced by the initiation of the main propellant charge reaches a pre-determined limit the septum 43 bursts allowing the gas to enter the channel 41 and reach the tracer composition 33 which it thereby ignites.

The narrow portion 41*b* allows this to be achieved without a build-up of undesirable high gas pressure behind the projectile 31. It is desirable to prevent such a build-up in order to prevent gas leakage on separation of the projectile 31 from the pusher 39 before acceleration starts.

On leaving the muzzle of the gun the sabot 35 is rapidly discarded allowing the projectile 31 to proceed toward the target. The tracer composition allows the trajectory of the projectile to be tracked in flight.

Figure 7:
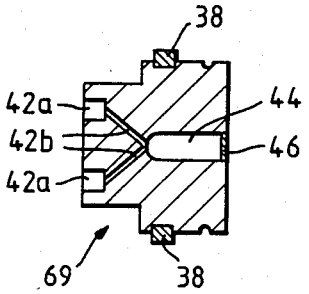
FIGS. 7 and 8 are cross-sectional side elevations of alternative base members for use in constructions embodying the present invention comprising a tubular projectile together with an associated pusher base.

In FIG. 7 there is shown an alternative base pusher 39. In this case, the channel 41 (FIG. 4) is replaced by a channel 42 which has a narrow portion 42*b* conically diverging laterally from a common cylindrically shaped aperture 44 housing a cylindrical septum 46. The narrow portions 42*b* open at their front end into an annular recess 42*a* similar to the recess 41*a* which is adjacent to the tracer composition 33 (FIG. 3). Operation of the FIG. 7 embodiment is similar to that of the FIG. 5 embodiment.

Figure 8:
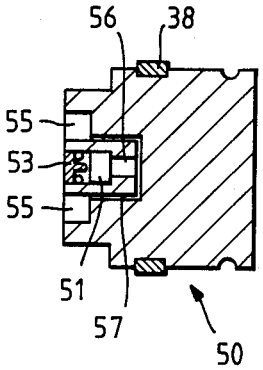

FIG. 8 shows a further alternative base pusher construction which may be used in conjunction with the projectile 31 and sabot 35 shown in FIG. 5. In the embodiment shown in FIG. 7 an igniter device 51 is housed inside the base pusher indicated by reference numeral 50 behind the projectile 31 (FIG. 3). A cap 53 having a striker pin is arranged in front of the device 51. An aperture 56 behind the device 51 leads into an annular recess 55, similar to the recess 41*a* shown in FIG. 1, via a narrow annular channel portion 57.

In operation of the FIG. 8 construction the cap 53 is set back by the projectile 31 (FIG. 3) upon firing the gun, causing its striker pin to initiate the device 51. Hot gas produced by initiation of device 51 flows from the aperture 56 to the recess 55 via the channel portion 57 thereby causing ignition of the tracer composition 33 (FIG. 3) adjacent to the recess 55. It will be appreciated that the method of ignition of the tracer composition 33 by the base pusher construction shown in FIG. 7 is an indirect method.

In a further alternative embodiment (not shown) the igniter device 51 and cap 53 may be replaced by a known igniter which is sensitive to and ignited by the spin, rather than the set-back, of the projectile 31.

In a further embodiment (not shown) a tubular projectile similar to those shown in FIGS. 1 or 2 or FIG. 3, 4 or 5 may be a full calibre projectile which is launched by a base pusher similar to that shown in FIG. 6, 7 or 8 but having a diameter substantially the same as that of the projectile. In this case the driving band is provided on the outer surface of the projectile.

Figure 9:
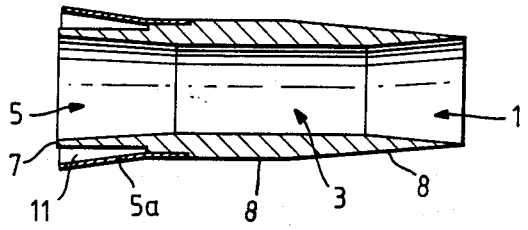
FIG. 9 is a cross-sectional side elevation of a projectile as shown in FIG. 1 in the course of manufacture.

FIG. 9 shows an example of a projectile as shown in FIG. 1 in the course of manufacture. This illustrates a method of filling the projectiles shown in FIG. 1 and FIGS. 3 to 5 with tracer material. In this example, the outer ring labelled 5*a* in FIG. 9, of the rear portion 5 surrounding the recess 11 is flared toward its rear surface 7 so that the recess 11, prior to insertion of its tracer material, has a greater cross-sectional area at its rear (outer) end than at its front (inner) end. A flexible sleeve of tracer material (not shown in FIG. 8) manufactured in one of the ways described above is inserted into the recess 11 and, after any necessary drying of solvent from the tracer material, the ring 5*a* ia swaged down so that the projectile is obtained in the form shown in FIG. 1.

Figure 10:
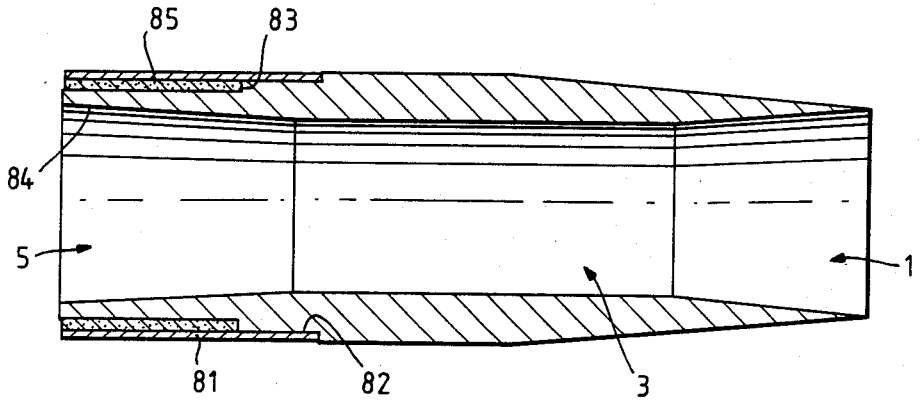
FIG. 10 is a cross-sectional side elevation of an alternative tubular projectile embodying the present invention.

FIG. 10 shows an alternative to the construction shown in FIG. 3. In the case of the FIG. 10 construction, the projectile comprises a front portion 1, a middle portion 3 and a rear portion 5 all similar to those of FIG. 3 but an insert 81 is provided as a collar fitted in a recess 82 in the rear outer wall of the projectile. The recess 82 has, extending from a step 83 toward the rear end of the projectile, a region 84 of increased spacing in which tracer material 85 is embedded inside the insert 81.

We claim:

1. A tubular projectile comprising a hollow tube and having formed in a rear end of a wall of the tube a recess of annular cross-section having inner and outer lateral extremities, the annulus constituting the said recess being substantially coaxial with the portion of the projectile in which it is formed, the recess being filled with a tracer material which comprises a flexible cylindrical sleeve of a polymer-bonded pyrotechnic composition.

2. A tubular projectile as claimed in claim 1 and wherein the said recess extends forward from the rear end of the tubular wall of the projectile, the rear end comprising a frustro-conical or substantially flat annulus.

3. A tubular projectile as claimed in claim 2 and wherein the inner and outer lateral extremities of the said recess as observed at the rear end of the projectile are contained in an intermediate region between the inner and outer diameters of the annulus comprising the rear surface.

4. A tubular projectile as claimed in claim 1 and wherein the said recess is formed as a gap between an insert mechanically engaged with the projectile and a portion of a wall of the projectile body at its rear end.

5. A tubular projectile as claimed in claim 4 and wherein the said recess is formed as a gap between an insert fitted in an inner wall of the projectile and a region of that wall extending inside the insert, the said insert having an inner surface which forms a surface substantially continuous with the inner surface of the body of the projectile forward of the insert.

6. A tubular projectile as claimed in claim, 4 and wherein the said recess is formed as a gap between said insert fitted in an outer wall of the projectile and a region of that wall extending inside the insert, the said insert having an outer surface which forms a surface substantially continuous with the outer surface of the body of the projectile forward of the insert.

7. A tubular projectile as claimed in claim 1 and wherein the projectile is a sub-calibre component of a round also comprising a discarding sabot.

8. A tubular projectile as claimed in claim 1 and wherein the projectile has in cross-section in a plane containing the projectile axis a front portion having an inner surface conical converging in a direction facing toward the rear end of the projectile, an intermediate portion having an inner surface of substantially constant diameter and a rear portion having an inner surface conically diverging in a direction facing toward the rear end of the projectile.

9. A tubular projectile as claimed in claim 1 which further comprises a base member fitted behind the rear end of the projectile, the base member having a groove facing the recess in the projectile incorporating the tracer material, the said groove being sealed by the rear end surface of the projectile.

10. A tubular projectile as claimed in claim 9 and wherein the base member incorporates an igniter device arranged to be initiated by the set-back force or spin of the projectile, the igniter device being located in a cavity in the base member which has one or more bleed channels extending from the cavity to the said groove in the base member which permits gas produced by initiation of the igniter device to be delivered to the tracer material.

11. A tubular projectile as claimed in claim 9 and wherein the base member includes a channel incorporating a narrow bleed hole or channel portion, the channel extending from the rear end of the base member to the said groove, the channel permitting gas at the rear end of the base member to be delivered to the said groove in the base member to ignite the tracer material in the recess adjacent thereto.

12. A tubular projectile as claimed in claim 10 and wherein the said channel incorporates a septum or burster disc or annulus which bursts at a pre-determined pressure allowing gas to be delivered along the channel only after bursting of the septum or burster disc or annulus 13. A projectile as claimed in claim 1 and wherein the flexible sleeve comprises a powdered metallic fuel and one or more fluoroelastomers serving as an oxidiser and flexible binder.

14. A projectile as claimed in claim 13 and wherein the material of the sleeve comprises magnesium 30 to 60 per cent by weight, polytetrafluorethylene 35 to 50% by weight and a rubbery binder 5 to 25% by weight.

15. A projectile as claimed in claim 14 and wherein the rubbery binder is a copolymer of vinylidene fluoride and hexafluoropropylene.

16. A projectile as claimed in claim 15 and wherein the material of the flexible sleeve comprises magnesium 48% by weight; polytetrafluorethylene 35% by weight and a copolymer of vinylidene fluoridene and hexafluoropropylene 17% by weight.

* * * * *